US008134297B2

(12) United States Patent
Busse et al.

(10) Patent No.: US 8,134,297 B2
(45) Date of Patent: Mar. 13, 2012

(54) BALLAST FOR A DISCHARGE LAMP WITH ADAPTIVE PREHEATING

(75) Inventors: Olaf Busse, München (DE); Markus Heckmann, Guangzhou (CN); Reinhard Lecheler, Neuburg/Donau (DE); Alfons Lechner, Hohenwart (DE); Siegfried Mayer, Moosinning (DE); Thomas Pollischansky, Stadtbergen (DE); Bernd Rudolph, Forstern (DE); Bernhard Schemmel, Wessling (DE); Kay Schmidtmann, München (DE); Harald Schmitt, München (DE); Thomas Siegmund, Otterfing (DE); Arwed Storm, Dachau (DE); Horst Werni, München (DE)

(73) Assignee: Osram AG, Munich (DE)

( * ) Notice: Subject to any disclaimer, the term of this patent is extended or adjusted under 35 U.S.C. 154(b) by 727 days.

(21) Appl. No.: 11/990,080

(22) PCT Filed: Aug. 30, 2006

(86) PCT No.: PCT/EP2006/065801

§ 371 (c)(1),
(2), (4) Date: Nov. 14, 2008

(87) PCT Pub. No.: WO2007/025976

PCT Pub. Date: Mar. 8, 2007

(65) Prior Publication Data

US 2010/0156299 A1 Jun. 24, 2010

(30) Foreign Application Priority Data

Aug. 31, 2005 (DE) ..... 20 2005 013 754 U

(51) Int. Cl.
*H05J 17/28* (2006.01)

(52) U.S. Cl. ..... 315/112; 315/118

(58) Field of Classification Search ..... 315/291, 315/246, 88, 89, 91, 112, 118, 200 R
See application file for complete search history.

(56) References Cited

U.S. PATENT DOCUMENTS

| | | | | |
|---|---|---|---|---|
| 5,455,486 | A | 10/1995 | Tobler | |
| 6,291,947 | B1 * | 9/2001 | Koeppl et al. | 315/307 |
| 6,359,387 | B1 | 3/2002 | Giannopoulos et al. | |
| 6,525,479 | B1 | 2/2003 | Keggenhoff et al. | |
| 6,657,403 | B2 * | 12/2003 | Schemmel et al. | 315/291 |
| 6,747,418 | B2 * | 6/2004 | Sowa | 315/244 |
| 7,193,375 | B2 * | 3/2007 | Rudolph | 315/360 |

(Continued)

FOREIGN PATENT DOCUMENTS

CN 1638593 A 7/2005

(Continued)

OTHER PUBLICATIONS

English language abstract for JP 10-340791 A.

(Continued)

*Primary Examiner* — Douglas W Owens
*Assistant Examiner* — Minh D A

(57) ABSTRACT

The present invention relates to an electronic ballast for discharge lamps (LA) which have preheatable electrodes (E1, E2). The electronic ballast has a measuring apparatus (M), which is designed to measure, during the preheating process, a variable, which is correlated with the electrode temperature increased by the preheating, of at least one of the electrodes (E1, E2) of a connected discharge lamp (LA), and a control apparatus (C), which is designed to match the electrode temperature, during the preheating process, in response to the measurement by adjusting an operational parameter of the electronic ballast. Furthermore, the electronic ballast is designed to detect cross discharges or a sufficient operating temperature of one of the electrodes (E1, E2) and possibly to ignite the discharge.

16 Claims, 3 Drawing Sheets

U.S. PATENT DOCUMENTS

| | | | | |
|---|---|---|---|---|
| 7,242,154 | B2 * | 7/2007 | Rudolph | 315/291 |
| 2005/0067980 | A1 * | 3/2005 | Krummel | 315/291 |

FOREIGN PATENT DOCUMENTS

| | | | |
|---|---|---|---|
| DE | 198 50 441 | A1 | 5/2000 |
| EP | 0 594 880 | A1 | 5/1994 |
| EP | 0 889 675 | A1 | 1/1999 |
| EP | 1 280 388 | A1 | 1/2003 |
| JP | 266894 | A | 3/1990 |
| JP | 10340791 | A | 12/1998 |
| JP | 2003168582 | A | 6/2003 |
| WO | 02/19778 | A2 | 3/2002 |
| WO | 2005/060320 | A1 | 6/2005 |

OTHER PUBLICATIONS

English language abstract for JP 2-66894 A.
English language abstract for JP 2003-168582 A.

* cited by examiner

BALLAST FOR A DISCHARGE LAMP WITH ADAPTIVE PREHEATING

TECHNICAL FIELD

The present invention relates to an electronic ballast for discharge lamps, to be precise specifically for those discharge lamps which have preheatable electrodes.

PRIOR ART

Electronic ballasts for operating discharge lamps, even those which are designed to operate discharge lamps having preheatable electrodes, are known per se. In principle, an electronic ballast generates a supply power for a connected discharge lamp which has the characteristics necessary for operating the discharge lamp, in particular a high-frequency AC voltage supply, from a given supply, for example a system supply.

The electrodes of a discharge lamp are often preheated prior to the discharge being ignited. In this manner, it is possible for the emission capability of the electrodes to be improved and for their service life to be extended. A preheating process typically lasts for between 0.4 s and slightly more than 2 s and takes place in accordance with a preheating program determined in a sequence controller.

DESCRIPTION OF THE INVENTION

The invention is based on the problem of specifying an improved ballast for discharge lamps having preheatable electrodes.

The invention relates to an electronic ballast for operating a discharge lamp having preheatable electrodes, characterized in that it has a measuring apparatus, which is designed to measure, during the preheating process, a variable, which is correlated with the electrode temperature increased by the preheating, of at least one of the electrodes of a connected discharge lamp, and a control apparatus, which is designed to match the electrode temperature, during the preheating process, in response to the measurement by adjusting an operational parameter of the electronic ballast.

Preferred refinements of the invention are specified in the dependent claims.

The invention is based on the knowledge that simply carrying out a predetermined preheating sequence can lead to an unsatisfactory result of the preheating process. Even if an electronic ballast is designed and used for operating discharge lamps in each case always of the same type, the preheating process may nevertheless be slightly different in the case of each individual discharge lamp. A progression of the preheating process which is different from lamp to lamp may be due to manufacturing tolerances of the preheatable electrodes and tolerances of the components of the electronic ballast.

For example, when using a stereotypical preheating sequence, the preheatable electrodes of one discharge lamp could not reach the desired temperature once the preheating time has expired, while in an extreme case, the preheating voltage across the electrodes of another discharge lamp leads to an undesirable cross discharge being ignited.

The aim is a preheating time which is as short as possible, i.e. preheating currents or preheating voltages which are as high as possible are intended to be used, without a voltage occurring across the electrodes which leads to a cross discharge.

The electronic ballast according to the invention has a measuring apparatus which is designed to measure, during the preheating process, the temperature of at least one electrode of at least one connected discharge lamp. In order to measure the electrode temperature, any desired property correlated with this temperature may be measured. Suitable variables are dealt with in the scope of the dependent claims.

A control apparatus compares the measured values of the measuring apparatus with standard values for the variable correlated with the electrode temperature. In the case of a discrepancy between the measured value and the standard value, the control device matches the subsequent progression of the preheating process by changing an operational parameter of the electronic ballast such that the discrepancy to be expected between a subsequent measurement and a corresponding standard value is smaller. The principle of this process is therefore one of closed-loop control.

The more measurements are carried out during the preheating process, the better the profile of the electrode temperature can be understood and the better the control device can intervene in an appropriate manner in the progression of the preheating process. Many measurements and matching operations entail a certain degree of complexity, however; the electronics need to be correspondingly designed.

In an embodiment of the invention which is minimalistic in this regard, a variable correlated with the electrode temperature is measured only once, preferably in the central region of the preheating interval to be expected. In response to this measurement, if required, there is an intervention by the control apparatus.

Examples of operational parameters of the electronic ballast which are suitable for matching the profile of the electrode temperature during the preheating process are as follows: the preheating current through the electrodes, the preheating voltage at the electrodes, the frequency of the high-frequency AC voltage supply generated by the electronic ballast and the duty factor of precisely this AC voltage supply.

The standard values for the variable correlated with the electrode temperature can be stored in a storage apparatus within the electronic ballast, or else permanently wired in the form of an electronic circuit, for example a circuit which has threshold value elements (comparators), to which the measured values are fed and whose threshold values are used to decide whether there is a discrepancy between the measured values and the standard values. Such a circuit could at the same time also implement the control apparatus.

Owing to the fact that the progression of the preheating process is matched to standard values by the control apparatus, an electronic ballast according to the invention can also have increased flexibility when using different lamp types. Although different lamp types may have different electrodes, it is possible, by means of the control circuit, to work towards an efficient preheating process.

The measuring apparatus is preferably designed to measure the electrode resistance as the variable correlated with the electrode temperature. The electrodes represent a nonreactive resistance with a positive temperature coefficient. The electrode resistance during the preheating time results from the preheating voltage and the preheating current, and is therefore easy to determine.

In one preferred embodiment of the invention, the measuring apparatus is designed to measure the cold resistance of one of the electrodes of a connected discharge lamp once the electronic ballast has been switched on and prior to or at the start of the preheating process. The cold resistance of an electrode is in this case understood to mean the resistance of an electrode when its temperature corresponds to the ambient temperature. In this preferred embodiment of the invention, too, the electrode resistance is measured during the preheating time by the measuring apparatus. The quotient of the present electrode resistance, i.e. the warm resistance, and the cold resistance, just as the electrode resistance itself, is approximately proportional to the temperature of the electrodes. However, since it is divided by the cold resistance, a standardized variable in this regard is used. This is interesting because the cold resistance may completely vary from lamp to lamp, but gives no indication of the temperature profile during the preheating process. For example, the control apparatus may be designed to carry out the determination of the quotient of the cold resistance measured by the measuring apparatus and the warm resistance likewise measured by the measuring apparatus.

The quotient of the present resistance of one of the electrodes and the cold resistance is not only of interest when matching to a standard progression for the preheating process, but also for determining unusual processes by means of the measuring apparatus to which it is possible to respond in a corresponding manner by means of the control apparatus.

The fact that it is possible for the control apparatus to intervene in the progression of the preheating process does not necessarily mean that the profile of the electrode temperature in each case needs to correspond to the standard values. Discrepancies are possible, in particular in the case of a few measured values.

For example, the electrode temperature may reach a sufficient value earlier than expected. In order to minimize the preheating time, the discharge should then be caused to ignite, for example by means of the control circuit. As soon as the quotient of the present electrode resistance and the cold resistance reaches a value of between 4 and 7 during the preheating time, the discharge is preferably ignited. A lower barrier for ignition of the discharge of 4.5 is further preferred and, independently of this, an upper barrier of 6.

If the voltage across an electrode of a connected discharge lamp exceeds a critical value during the preheating process, a cross discharge may occur. Cross discharges are undesirable, inter alia because the electrode temperature is reduced again with a cross discharge. At a lower temperature, the electrode has a lower emission capacity, and ignition of the discharge at a temperature which is too low increases wear. Cross discharges can be recognized from a non-monotonic profile of a variable correlated with the electrode temperature. If a cross discharge is determined, a preferred embodiment of the invention is designed to introduce ignition.

A drop in the temperature across an electrode can be determined using a non-monotonic profile of a variable correlated with the electrode temperature within the preheating time. For example, in the case of a cross discharge across the electrode, its resistance and the voltage drop across it also decrease. However, the current through the electrode increases owing to the lower resistance. How severe these characteristics are also depends on whether the heating power supply tends to have a voltage source characteristic or a current source characteristic. In reality, the properties of the heating power supply will be between these extremes.

In one preferred embodiment of the invention, the variable which is correlated with the electrode temperature and is used for detecting cross discharges is the voltage across one of the electrodes.

If the electronic ballast has a pronounced current source characteristic, it is expedient to observe the voltage across one of the electrodes for detecting cross discharges. If the electronic ballast is a pronounced voltage source, cross discharge detection using the quotient of the warm resistance and the cold resistance, which is determined via a current measurement, is suitable.

In order to track the variable correlating with the temperature of one of the electrodes during the preheating process, this variable is preferably measured at least every 100 ms by the measuring apparatus. Given the conventional preheating times, a plurality of measurements are therefore possible during the preheating process.

If the electronic ballast can be operated not only with one lamp type but with a plurality of different lamp types, lamp type identification can advantageously be used. The lamp type is preferably determined by means of measuring the cold resistance of an electrode of a connected discharge lamp. In one preferred embodiment of the invention, the memory apparatus is designed to store in each case a set of appropriate preheating parameters for various lamp types, for example the preheating duration, standard values for the heating current and the heating voltage and the maximum permitted heating voltage. If the electronic ballast has identified the connected lamp type using the cold resistance, the control apparatus controls the preheating process in accordance with the standard values corresponding to the lamp type.

During operation on the supply system, it may arise that, in the meantime, this supply system fails. The electronic ballast may be equipped with a timing element in order to determine whether the system interruption was shorter than a predetermined duration. If this is the case, no measurement of the cold resistance is carried out after the system interruption, while in the other case it is.

The description of the individual features above and below relates to the apparatus aspect and also a method corresponding to the invention without explicit mention being made of this in detail.

The invention in principle therefore also relates to a method for operating a discharge lamp equipped with preheatable electrodes, having the following steps: connecting the discharge lamp, measuring a variable, which is correlated with the electrode temperature increased by the preheating, of at least one of the electrodes during the preheating process using a measuring apparatus, and matching the electrode temperature during the preheating process by adjusting an operational parameter of the electronic ballast by means of a control apparatus responding to the measurement. The invention also relates to the refinements explained above and below which are also implicit for this method.

BRIEF DESCRIPTION OF THE DRAWINGS

The invention will be explained in more detail below with reference to exemplary embodiments. The individual features disclosed in the process may also be essential to the invention in other combinations.

PREFERRED EMBODIMENT OF THE INVENTION

Figure 1:
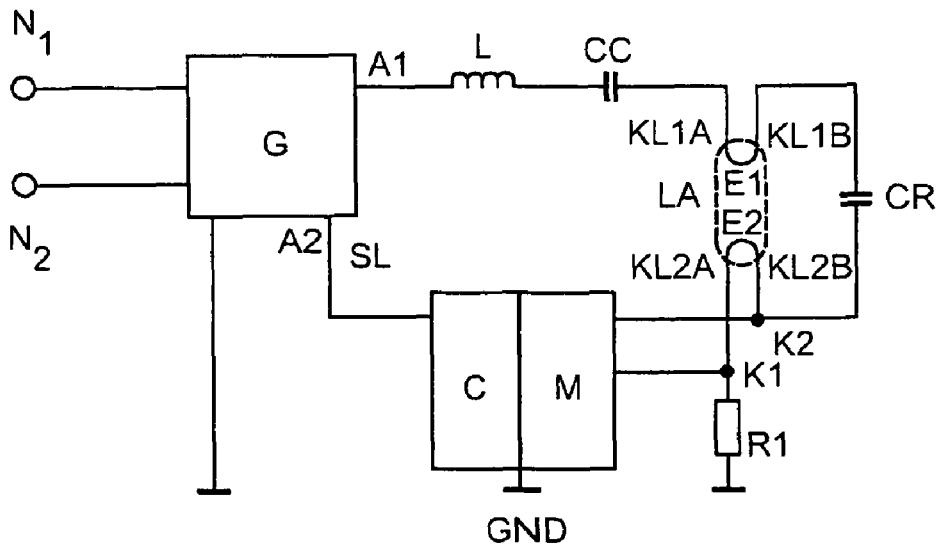
FIG. 1 shows a circuit diagram of an electronic ballast according to the invention.

FIG. 1 shows a circuit diagram of an electronic ballast according to the invention.

The electronic ballast is fed from the system supply lines N1 and N2. A generator G generates a supply power for a connected low-pressure discharge lamp LA from the provided system supply N1, N2. The generator G contains a rectifier for rectifying the AC voltage supply, a power factor correction circuit for drawing current from the system supply which is as sinusoidal as possible, an intermediate circuit capacitor and a half-bridge inverter, the DC voltage required for supplying the half-bridge inverter being present across the intermediate circuit capacitor. The half-bridge inverter generates a high-frequency AC voltage between the output A1 and the reference potential GND or the other potential of the intermediate circuit voltage.

A series circuit comprising a lamp inductor L, a coupling capacitor CC, a lamp terminal KL1A, the low-pressure discharge lamp LA, a lamp terminal KL2A and a resistance R1 is connected between the first output A1 and the reference potential GND. Connected in parallel with the series circuit comprising the lamp terminal KL1A, the low-pressure discharge lamp LA and the lamp terminal KL2A is a series circuit comprising a lamp terminal KL1B, a resonant capacitor CR and a lamp terminal KL2B. The electrode E1 is positioned between the lamp terminals KL1A and KL1B, and the electrode E2 is positioned between the lamp terminals KL2A and KL2B.

A connection node K1 is positioned between the lamp terminal KL2A and the resistance R1. A control apparatus C and a measuring apparatus M are connected between a second output at the generator A2 and the connection node K1. The control apparatus C and the measuring apparatus M are part of a microcontroller and are therefore encompassed together in the drawing. Both the control apparatus C and the measuring apparatus M have a reference to the reference potential GND. The control apparatus C can adjust operational parameters of the generator G, in this case the heating current, via a control line SL. The measuring apparatus is connected in series with the reference potential GND via the node K1. Furthermore, the measuring apparatus M is connected in series with the resonant capacitor CR via the lamp terminal KL2B. A connection node K2 is positioned between the resonant capacitor CR and the measuring apparatus M. The lamp terminal KL2B is connected to this connection node.

The voltage drop across the resistance R1 is proportional to the current flowing through the electrode E2 between the lamp terminals KL2A and KL2B. The voltage across the resistance R1 can be detected by the measuring apparatus M. The voltage between the lamp terminals KL2A and KL2B can also be detected by the measuring apparatus M.

Figure 2:
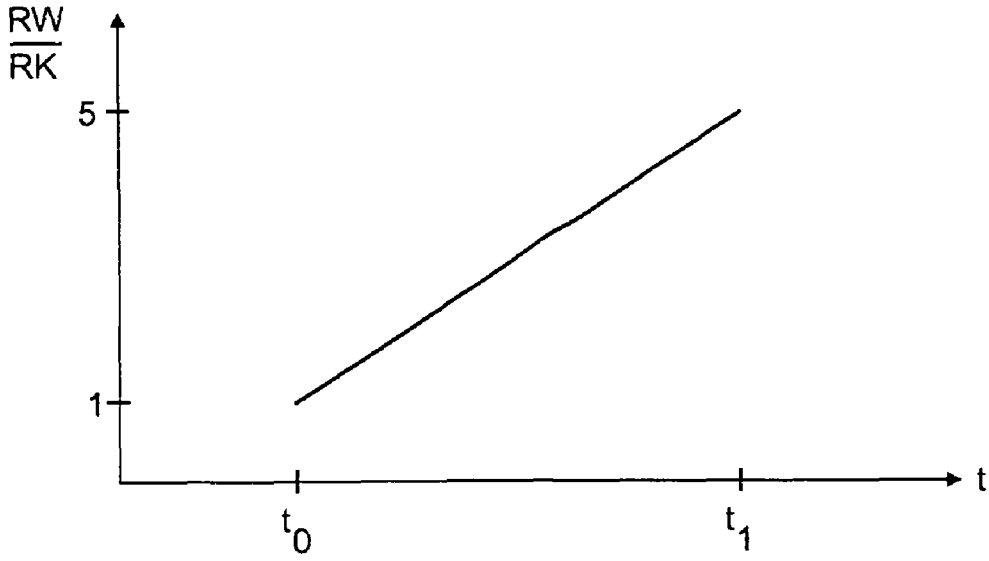
FIG. 2 shows a time profile of a variable correlated with the electrode temperature.

FIG. 2 shows a typical profile of a variable correlated with the electrode temperature of the low-pressure discharge lamp LA during the preheating process. The measuring apparatus M measures, in this case 10 times, the resistance RW of the electrode E2 between the lamp terminals KL2A and KL2B during the preheating time. The preheating process begins at time t0 and ends at time t1. As the temperature increases, the resistance RW of the electrode also increases and reaches its highest value up until then at the end t1 of the preheating time, in this case after 0.5 s. Before the preheating process has led to significant heating, the electrode resistance has the value RK, its cold resistance. As the variable correlated with the electrode temperature, in this case the quotient of RW and RK is represented as a function of time, and this quotient reaches the value 5 at the end t1 of the preheating time, which corresponds to an electrode temperature of almost 800° C.

Figure 3A:
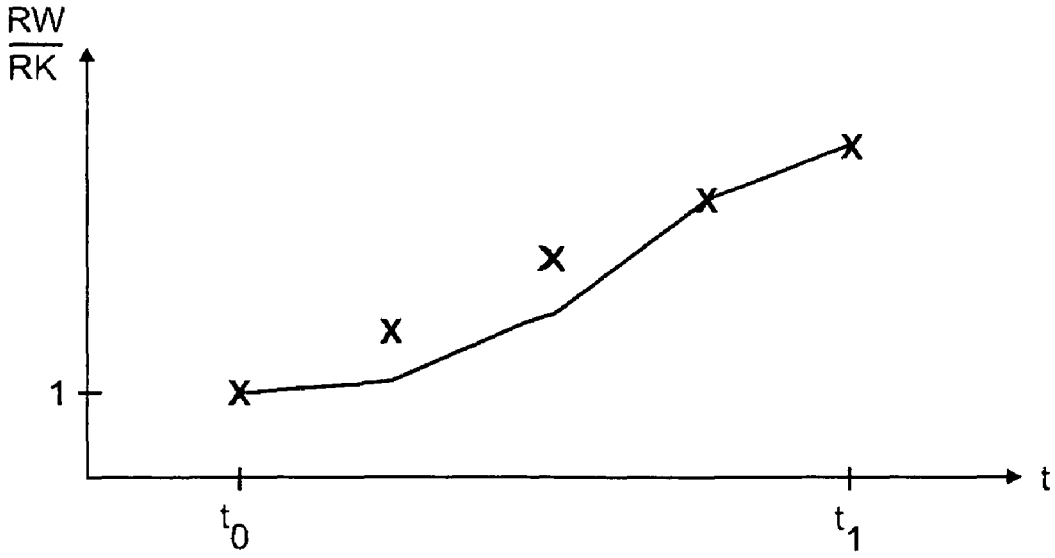
FIG. 3 shows a time profile of a variable correlated with the electrode temperature and an associated heating current, which is matched during the preheating process.
Figure 3B:
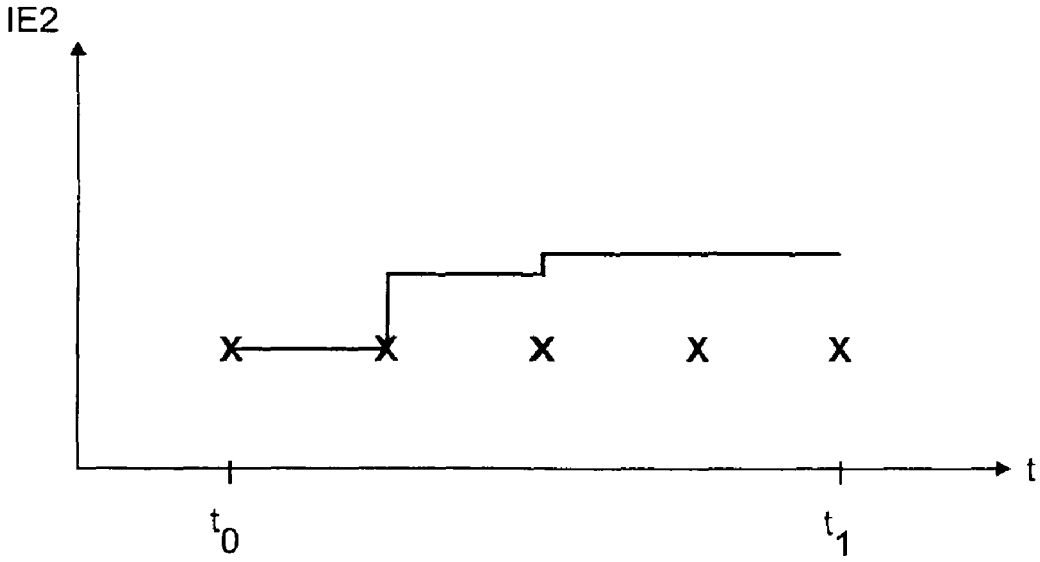

FIG. 3*a* shows a time profile of the quotient of the warm resistance and the cold resistance, and FIG. 3*b* shows the associated heating current IE2, the heating current through the electrode 2, which is matched during the preheating process. In the control apparatus C, in each case five standard values, which occur over the course of the preheating process, for the quotient of the warm resistance and the cold resistance and the heating current are stored for various lamp types. Prior to the beginning of the preheating process, the measuring apparatus M determines the cold resistance of the electrode E2. Using the cold resistance RK of the electrode E2, the lamp type is detected and the standard values corresponding to the detected lamp type are selected as a comparison scale for the control apparatus C for the preheating process. The crosses in FIGS. 3*a* and 3*b* each correspond to the standard values stored in the control apparatus. The continuous line in FIG. 3*a* corresponds to the actual profile of the quotient of the warm resistance and the cold resistance, and the continuous line in FIG. 3*b* corresponds to the actual profile of the heating current during the preheating time. In FIG. 3*a*, it can be seen that the quotient of the warm resistance and the cold resistance initially does not increase quickly enough in order to correspond to the standard values. The control apparatus intervenes in an appropriate manner and increases the heating current, with the result that the quotient of the warm resistance and the cold resistance has a greater gradient. The change in the heating current is in this case selected so as to be proportional to the difference between the measured quotient of the warm resistance and the cold resistance and the associated standard value.

Figure 4:
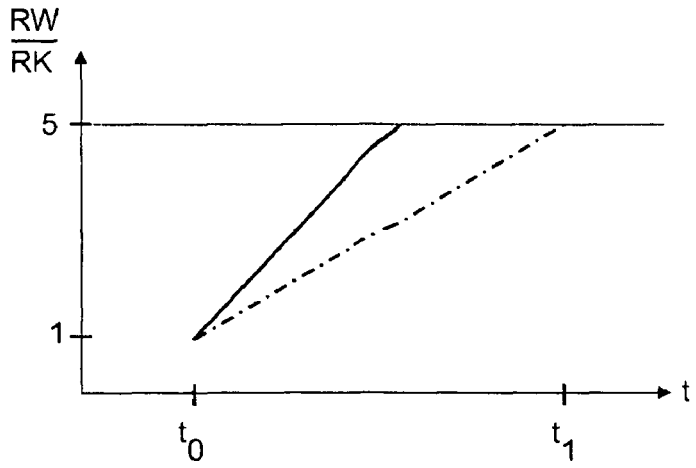
FIG. 4 shows a variation of FIG. 2.

FIG. 4 shows the quotient of RW and RK as a function of time during the preheating process for two different preheating processes. In the first preheating process (dash-dotted line), a typical profile can be seen, as in FIG. 2. The preheating process is ended at time t1. In the second preheating process (continuous line), the quotient reaches the value 5 before the expected end t1 of the preheating time. However, if the quotient reaches the value 5, the electrode is hot enough and the discharge is ignited.

Figure 5:
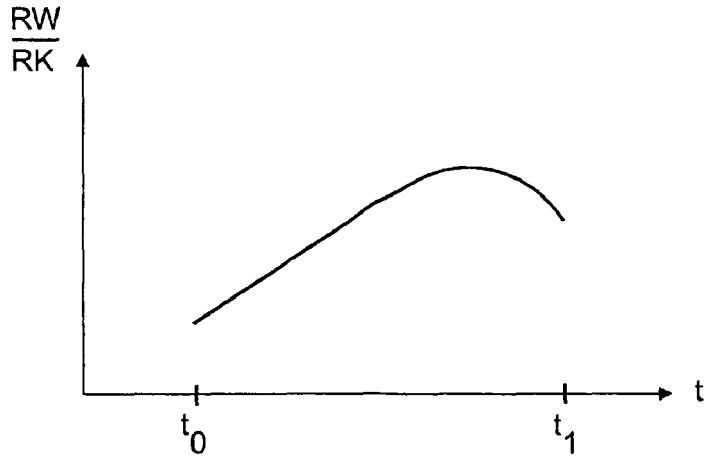
FIG. 5 shows a further variation of FIG. 2.

If, during the preheating process, a cross discharge occurs at the electrode E2, the temperature of the electrode which initially rose falls again. This is shown in FIG. 5 and is also expressed by the fact that the quotient of the present electrode resistance RW and the cold resistance RK decreases. The measuring apparatus M in this case carries out ten measurements of the electrode resistance RW in the interval between t0 and t1. If the electrode resistance falls within this interval, after it has initially risen, this is an indication of a cross discharge; the discharge is ignited.

Figure 6:
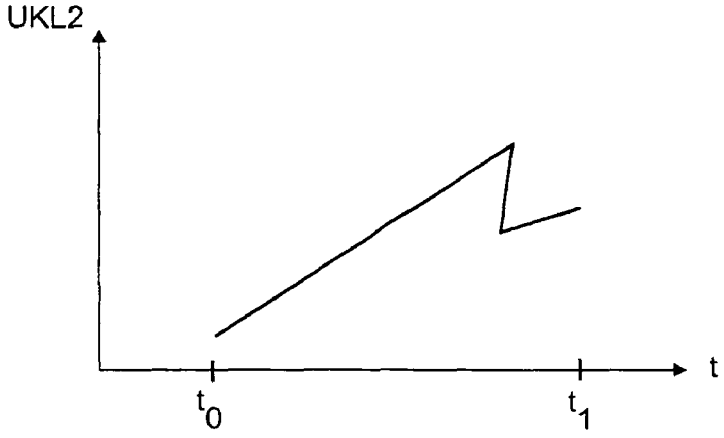
FIG. 6 shows yet another variation of FIG. 2.

There is a similar profile in FIG. 6. If a cross discharge occurs across one of the electrodes, the voltage across this electrode dips. The voltage UKL2 across the electrode E2 is measured by the measuring apparatus M. If the voltage UKL2 drops during the preheating process, after it has initially risen, in this case, too, the ignition of the discharge is brought about by means of the control apparatus C.

The invention claimed is:

1. An electronic ballast for operating a discharge lamp having preheatable electrodes, characterized in that it has a measuring apparatus, which is designed to measure, during the preheating process, a variable, which is correlated with the electrode temperature increased by the preheating, of at least one of the electrodes of a connected discharge lamp, and a control apparatus, which is designed to match the electrode temperature, during the preheating process, in response to the measurement by adjusting an operational parameter of the electronic ballast.

2. The electronic ballast as claimed in claim 1, in which the measuring apparatus is designed to repeatedly measure the electrode temperature of one of the electrodes.

3. The electronic ballast as claimed in claim 2, in which the variable correlated with the electrode temperature is the resistance.

4. The electronic ballast as claimed in claim 2, in which the control circuit is designed to determine the quotient of the present warm resistance and the initial cold resistance of one of the electrodes.

5. The electronic ballast as claimed in claim 2, in which the control circuit is designed to ignite the discharge in the case of a non-monotonic profile of a variable, which is correlated with the electrode temperature, during the preheating process.

6. The electronic ballast as claimed in claim 2, in which the measuring apparatus is designed to measure the variable, which is correlated with the electrode temperature, of at least one of the electrodes at least every 100 ms.

7. The electronic ballast as claimed in claim 2, which has a storage apparatus and in the case of which in each case standard values for the variable correlated with the electrode temperature are stored in the storage apparatus for various lamp types and in the case of which the measuring apparatus is designed to detect the cold resistance of one of the electrodes once the electronic ballast has been switched on and prior to the start of the preheating process of the electrodes, to detect the lamp type on the basis of the cold resistance of one of the electrodes, and to select the standard values corresponding to the detected lamp type as the comparison scale for the control apparatus for the preheating process.

8. The electronic ballast as claimed in claim 1, in which the variable correlated with the electrode temperature is the resistance.

9. The electronic ballast as claimed in claim 1, in which the control circuit is designed to determine the quotient of the present warm resistance and the initial cold resistance of one of the electrodes.

10. The electronic ballast as claimed in claim 9, which is designed to ignite the discharge if the quotient of the warm resistance and the cold resistance exceeds an upper barrier.

11. The electronic ballast as claimed in claim 10, in which the upper barrier is greater than or equal to 4 and less than or equal to 7.

12. The electronic ballast as claimed in claim 1, in which the control circuit is designed to ignite the discharge in the case of a non-monotonic profile of a variable, which is correlated with the electrode temperature, during the preheating process.

13. The electronic ballast as claimed in claim 12, in which the correlated variable is the voltage across one of the electrodes.

14. The electronic ballast as claimed in claim 1, in which the measuring apparatus is designed to measure the variable, which is correlated with the electrode temperature, of at least one of the electrodes at least every 100 ms.

15. The electronic ballast as claimed in claim 1, which has a storage apparatus and in the case of which in each case standard values for the variable correlated with the electrode temperature are stored in the storage apparatus for various lamp types and in the case of which the measuring apparatus is designed to detect the cold resistance of one of the electrodes once the electronic ballast has been switched on and prior to the start of the preheating process of the electrodes, to detect the lamp type on the basis of the cold resistance of one of the electrodes, and to select the standard values corresponding to the detected lamp type as the comparison scale for the control apparatus for the preheating process.

16. The electronic ballast as claimed in claim 1 for operating a low-pressure discharge lamp.

* * * * *